US006784859B2

(12) United States Patent
Setoguchi et al.

(10) Patent No.: US 6,784,859 B2
(45) Date of Patent: Aug. 31, 2004

(54) PLASMA DISPLAY DRIVE METHOD

(75) Inventors: Noriaki Setoguchi, Higashimorokata (JP); Tomokatsu Kishi, Kawasaki (JP)

(73) Assignee: Fujitsu Hitachi Plasma Display Limited, Kawasaki (JP)

( * ) Notice: Subject to any disclaimer, the term of this patent is extended or adjusted under 35 U.S.C. 154(b) by 97 days.

(21) Appl. No.: 09/933,113

(22) Filed: Aug. 21, 2001

(65) Prior Publication Data

US 2002/0050960 A1 May 2, 2002

(30) Foreign Application Priority Data

Nov. 2, 2000 (JP) ..... 2000-336248

(51) Int. Cl.[7] ..... G09G 3/28

(52) U.S. Cl. ..... 345/60; 345/62; 345/67; 345/68; 345/210; 315/169.4

(58) Field of Search ..... 345/60–68, 204, 345/208, 209, 210; 315/169.4, 169.3

(56) References Cited

U.S. PATENT DOCUMENTS 5,446,344 A * 8/1995 Kanazawa ..... 315/169.4
5,663,741 A 9/1997 Kanazawa ..... 345/66
6,243,084 B1 * 6/2001 Nagai ..... 345/210
6,249,087 B1 * 6/2001 Takayama et al. ..... 315/169.4

FOREIGN PATENT DOCUMENTS

| | | |
|---|---|---|
| EP | 0 762 373 | 3/1997 |
| EP | 0 965 975 | 12/1999 |
| JP | 6-314078 | 11/1994 |
| JP | 2000-75835 | 3/2000 |

* cited by examiner

*Primary Examiner*—Lun-Yi Lao
(74) *Attorney, Agent, or Firm*—Staas & Halsey LLP

(57) ABSTRACT

A plasma display drive method, in which the address action is carried out in a short time without fail, has been disclosed. In the reset action, wall charges are left uniformly in the display cell, and the following address action comprises the selective action to select the OFF cell, the eliminative action to eliminate the wall charges in the OFF cell selected in the selective action, and the write action to form wall charges needed for the sustain action in the ON cell.

12 Claims, 12 Drawing Sheets

ON CELL

OFF CELL

ODD FIELD

EVEN FIELD

ODD FIELD

PLASMA DISPLAY DRIVE METHOD

BACKGROUND OF THE INVENTION

The present invention relates to a plasma display drive method. More particularly, the present invention relates to a technology to shorten the period of the address action.

The plasma display (PD) apparatus has good visibility because it generates its own light, is thin and can be made with a large-screen and high-speed display, therefore, it is attracting interest as a replacement for CRT displays.

FIG. 1 is a diagram that shows the basic structure of a PD apparatus.

As shown in FIG. 1, in a plasma display panel (PDP) 10, X electrodes (the first electrode: sustain electrode) X1, X2, . . . , and Y electrodes (the second electrode: scan electrode) are arranged adjacently by turns and address electrodes (the third electrode) A1, A2, . . . are arranged in the direction perpendicular to that of the X and Y electrodes. A display line is formed between a pair of X electrode and Y electrodes, that is, between X1 and Y1, X2 and Y2, and so on, and a display cell (hereinafter simply referred to as cell) is formed at the point where a display line and an address electrode intersect.

The X electrodes are connected to an X sustain circuit 14 and the same drive signal is applied thereto. The Y electrodes are individually connected to a Y scan driver 12 and scan pulses are applied sequentially in the address action, which will be described later, otherwise the same address signal is applied thereto by a Y sustain circuit 13. The address electrodes are connected to an address driver 11, and an address signal to select ON cells and OFF cells is applied in synchronization with the scan-pulse in the address action, otherwise the same drive signal is applied. A control circuit 15 outputs a signal that controls each of the above-mentioned parts.

FIG. 2 is a diagram that shows the structure of a frame to describe the drive sequence in the PD apparatus. Since the discharge of the plasma display has only two states, that is, ON and OFF, the gradation of display is represented by the number of times of light emission. Therefore, a frame corresponding to a display is divided into plural subfields as shown in FIG. 2. Each subfield comprises the reset period, the address period, and the sustain discharge period (sustain period). In the reset period, an action is carried out that brings all the cells, regardless whether the cell was ON or OFF in the previous field, into a homogeneous state, for example, a state in which wall charges are eliminated or wall charges are formed uniformly. In the address period, a selective discharge (address discharge) is carried out in order to determine the ON or OFF state of a cell according to the display data and wall charges needed to carry out a discharge for light emission in the next sustain period are formed in an ON state cell. In the sustain period, discharge is carried out repeatedly for light emission in the cell put into the ON state in the address period. The length of the sustain period, that is, the number of times of light emission differs from subfield to subfield, and the gradation of display can be represented by setting the number of times of light emission in a ratio, for example, 1:2:4:8 . . . , and combining subfields to emit light for each cell according to the gradation.

FIG. 3 is a waveform chart that shows an example of the conventional drive method of a plasma display panel. As shown schematically, in the reset period, a pulse of a voltage Vw larger than the discharge starting voltage, 300 V for example, is applied to the x electrode. The application of this pulse causes discharge in every cell regardless whether the cell was ON or OFF in the previous subfield and wall charges are formed. When this pulse is removed, discharge is caused again by the voltage of the wall charges themselves, but because there is no difference in potential between electrodes, the space charges generated by the discharge are neutralized and a homogeneous state without wall charges is realized. Although almost all charges are neutralized, a small amount of ions or metastable atoms remains in the discharge space. It may be a case that these remaining charges are used as pilot charges to cause the next address discharge, without fail. This is called, in general, the pilot effect or the priming effect. In the address period, a scan pulse is applied sequentially to the Y electrode and an address pulse (address signal) is applied to the address electrode of the cell to be turned ON in the display line to cause discharge. This discharge propagates to the X electrode side and wall charges are formed between the X electrode and the Y electrode. This scanning is performed over all the display lines. Next, sustain pulses of a voltage Vs (approx. 170 V) are applied repeatedly to the X electrode and the Y electrode in the sustain period. When the sustain pulses are applied, the cell in which wall charges are formed in the address period carries out discharge because the voltage of the wall charges is superposed on that of the sustain pulse and the total voltage exceeds the discharge starting voltage. The cell, in which no wall charge is formed in the address period, does not discharge.

The basic structure and action of the plasma display apparatus are described as above, and moreover various examples of modification have been proposed. In one of the modifications, for example, plural subfields with the same number of times of light emission are provided in the frame structure in FIG. 2 to make an animation display smoothly. In another modification, a reset action is carried out only in the first subfield of a frame and not in the following subfields. In another modification, a reset is not carried out in all the cells but only in the cells that were ON in the previous subfield. In another modification, homogeneous wall charges are left in the reset action and the eliminative address method may be used to select cells that are OFF to eliminate wall charges in the address action. In another modification, a desired amount of charges is left, to use in the address action, by applying a voltage between the X electrode and the Y electrode from which the reset pulse is removed. Moreover, the present applicant has disclosed a structure in which homogeneous charges are left, on the entire surface, by designing the rise in voltage of reset pulse into an obtuse waveform so that the voltage changes gradually, in Japanese Unexamined Patent Publication (Kokai) No. 6-314078, and also in Japanese Unexamined Patent Publication (Kokai) No. 2000-75835, the structure in which both the rise and fall of the reset pulse are designed as to be waveforms with a gradual slope. Furthermore, the applicant has disclosed the so-called ALIS method plasma display apparatus in which the number of display lines is doubled without changing the number of X electrodes and Y electrodes by forming display lines in every slit between the X electrodes and the Y electrodes, that is, between each Y electrode and both the X electrodes on both sides, in EP 0 762 373 A2.

As explained so far, there are various modifications of the plasma display apparatus, and the present invention can be applied to each one of them.

A high quality of display, which exceeds that of CRT, is required from the plasma display apparatus. The factors that will realize a high quality of display include the high definition, the high gradation, the high brightness, the high contrast, and so on. To achieve a high definition, it is necessary to increase the numbers of display lines and display cells by narrowing the pitch, and the above-mentioned ALIS method has a structure that enables the realization of a high definition at a low cost. To achieve a high contrast, it is necessary to decrease the intensity of discharge and the number of times of discharge, caused by the reset pulse, not relating to the display.

To achieve a high gradation, it is necessary to increase the number of subfields in the frame to increase the number of gradation levels that can be represented, but this also requires that the time required for the reset action and the address action be abbreviated or the period of the sustain discharge be abbreviated. To achieve a high brightness, it may be possible that the intensity of a sustain discharge is increased, but this will lead to a problem in that the fluorescent materials are degraded, and another measure may be that the number of times of sustain discharge in the frame is increased. To increase the number of times of sustain discharge, it is necessary to abbreviate the period of sustain discharge or increase the ratio of the sustain period by abbreviating the time required for the reset action and the address action as described above. The abbreviation of the sustain action period, however, has its own limit in the current structure because the stable occurrence of sustain discharge needs to be maintained. Therefore, it can be another measure in that a higher gradation and a higher brightness are achieved by the abbreviation of time required for the reset action and the address action.

The present invention relates to a drive method to abbreviate the time required for the address action and aims at a higher gradation by increasing the number of subfields in the frame or at a high brightness by increasing the ratio of the sustain period.

In the conventional drive method, described with reference to FIG. 3, an address signal is applied to the address electrode while applying a scan pulse to the Y electrode sequentially after a homogeneous state without wall charges is achieved by the reset action, the trigger discharge and the surface discharge are carried out in the ON cell and wall charges needed to emit light in the next sustain action are formed. Therefore, a display line needs approximately 2 $\mu$s. For a panel with 500 lines, 1 ms is needed for one time address action, and 2 ms are needed for a panel with 1000 lines. This means that the time required for the address action occupies a large part of a series of sequence and it is necessary to reduce this time.

SUMMARY OF THE INVENTION

As described above, the eliminative address method, which provides a state in which wall charges remain uniformly in the reset action and eliminates the wall charges of the OFF cell in the address action, is carried out and this method can abbreviate the time required for the address action because wall charges do not need to be formed. Concerning this eliminative address method, however, there appears a problem that the operation is unstable, the operation margin is very small, and a stable drive is difficult to maintain, because a pulse of a narrow width is applied. The object of the present invention is to realize a drive method of a plasma display that enables stable address action in a shorter time.

To realize the above object, the plasma display drive method of the present invention is characterized in that wall charges are left uniformly in the reset action and the following address action comprises a selective action to select OFF cells, an eliminative action that eliminates the wall charges of the OFF cells selected in the selective action, and a write action that forms the wall charges needed to perform the sustain action to the ON cells.

In the selective action, an address signal is applied to the address electrode while applying a scan pulse to the Y electrode (scan electrode) sequentially to carry out discharge in the OFF cell. This action is similar to the conventional eliminative address method and, because it does not need to form wall charges, the time required for a display line is comparably short, and the time required for the entire surface is also short. In the next eliminative action, the wall charges in the OFF cell selected in the selective action are eliminated without fail. For this, a slope pulse with a gradual change is applied, for example, but the required time is short because the entire surface is treated at the same time. At the time the eliminative action is completed, the wall charges after the reset action remain in the ON cell, and the wall charges in the OFF cell are eliminated, therefore, a pulse is applied between the X electrode and the Y electrode so that discharge is carried out only in the ON cell to form the wall charges needed to carry out the next sustain action. Because the write action can also be carried out on the entire surface simultaneously, the required time is short. By the write action, the wall charges necessary for sustain are formed in the ON cell, no charge remains in the OFF cell, and the sustain action can be carried out without fail according to the display data.

In other words, the plasma display drive method of the present invention is characterized in that the eliminative action and the write action are added to form the wall charges needed to carry out the next sustain action stably, after the conventional eliminative address method is performed.

When the present invention is applied to the above ALIS method plasma display, the selective action and the eliminative action can be carried out in the same way as in the normal plasma display, but the write action differs slightly. In the write action in the odd field, a voltage is applied between the X electrode (the first electrode: sustain electrode) and the Y electrode (the second electrode: scan electrode) that form a display line in the odd field, but not applied between the x electrode and the Y electrode that form a display line in the even field. In the write action in the even field, a voltage is applied between the X electrode and the Y electrode that form a display line in the even field, but not applied between the X electrode and the Y electrode that form a display line in the odd field. Moreover, when such write action is carried out to a display line in the odd field, it is necessary to apply a voltage of reverse polarity to a display line in the contiguous odd field, and the write discharge is carried out at every two display lines if a voltage of one of the polarities is applied. Therefore, after a voltage of a polarity is applied, a voltage of the other polarity is applied to carry out the write discharge in the remaining display lines in the odd field. This applies when the write action is carried out to display lines in the even field.

BRIEF DESCRIPTION OF THE DRAWINGS

The present invention will be more clearly understood, from the description as set below, after reference to the accompanying drawings, wherein.

DESCRIPTION OF THE PREFERRED EMBODIMENTS

Figure 1:
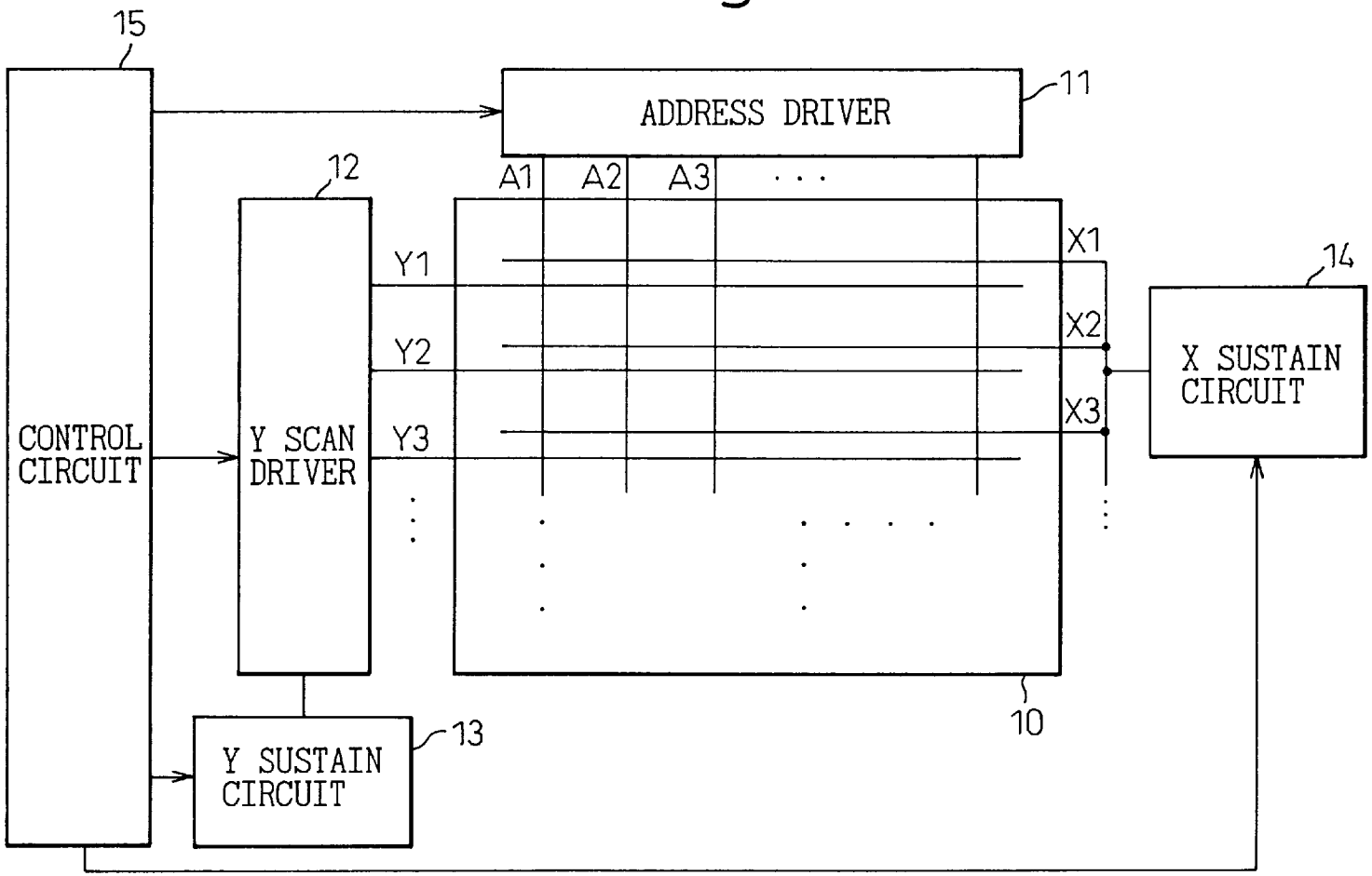
FIG. 1 is a block diagram that shows the basic structure of the plasma display apparatus.

The embodiments of the present invention are described below. The first embodiment of the present invention is an example case where the present invention is applied to the conventional plasma display apparatus in FIG. 1.

Figure 4:
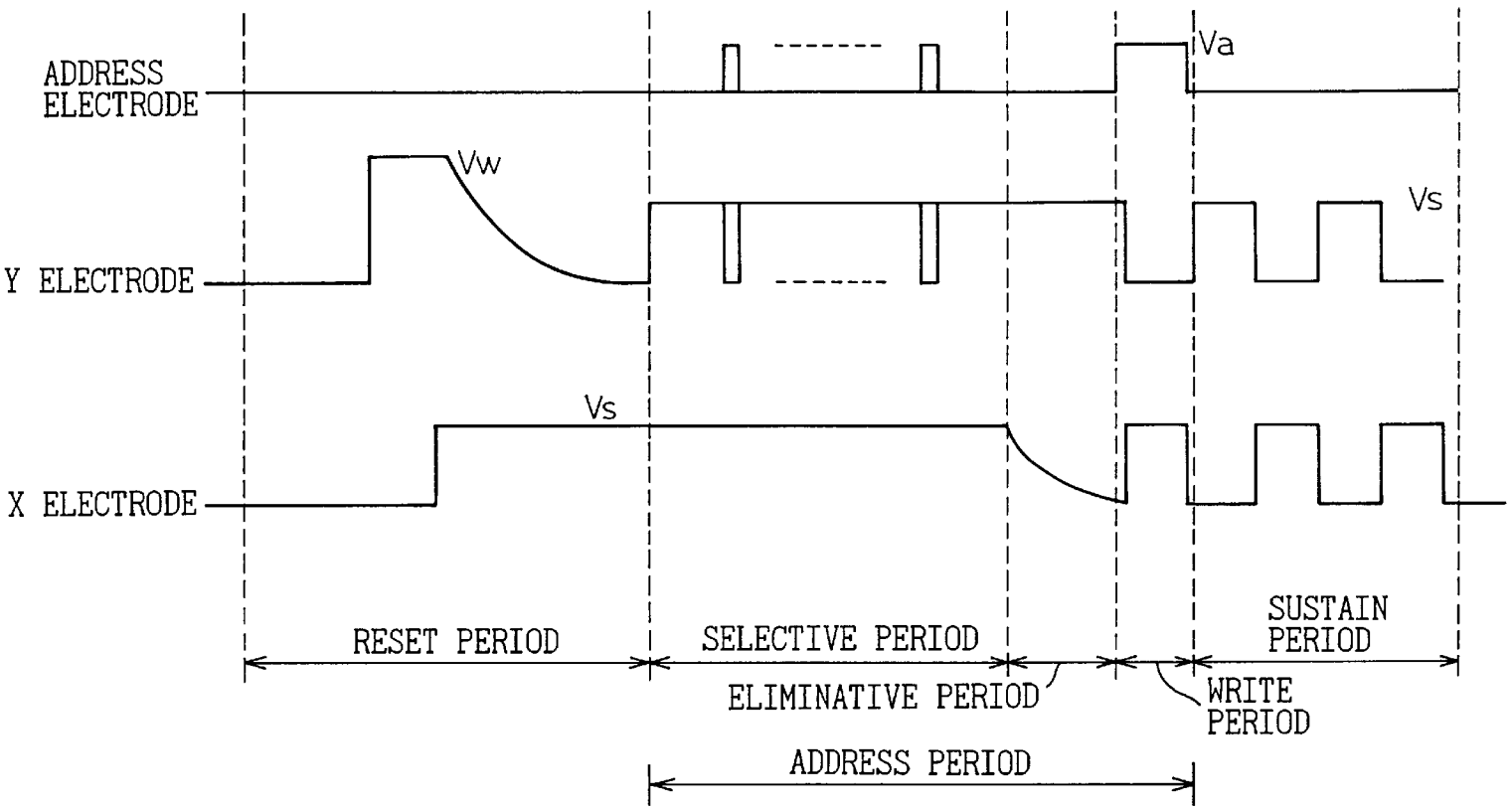
FIG. 4 is a diagram that shows the drive waveform in the first embodiment of the present invention.
Figure 5A:
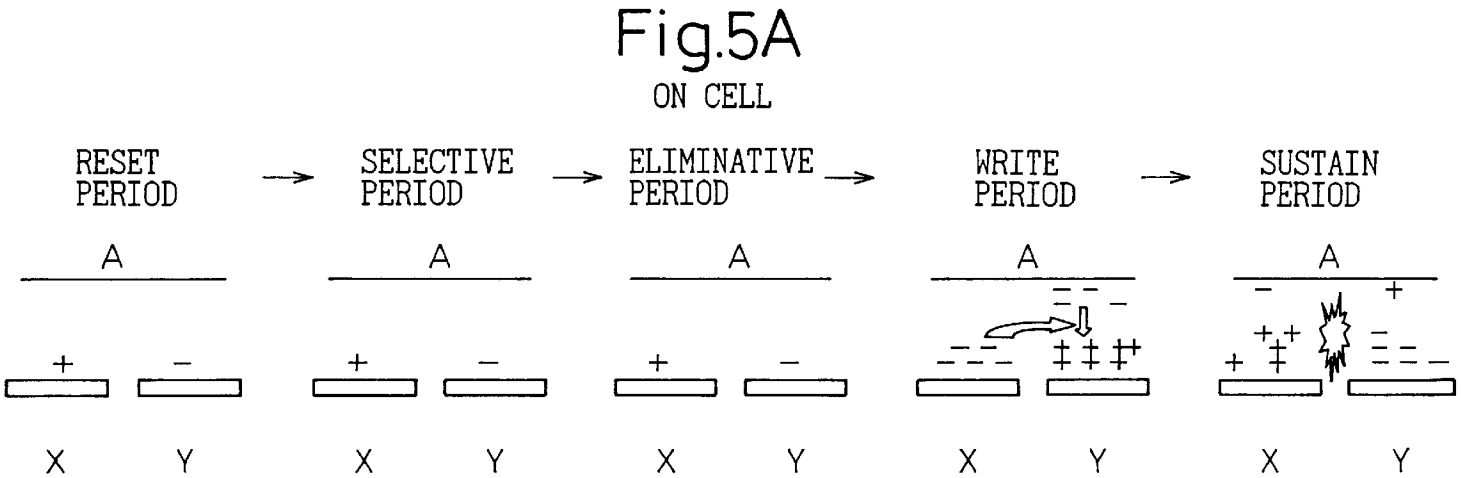
FIGS. 5A and 5B are diagrams that show the change of the wall charges on each electrode in the first embodiment.
Figure 5B:
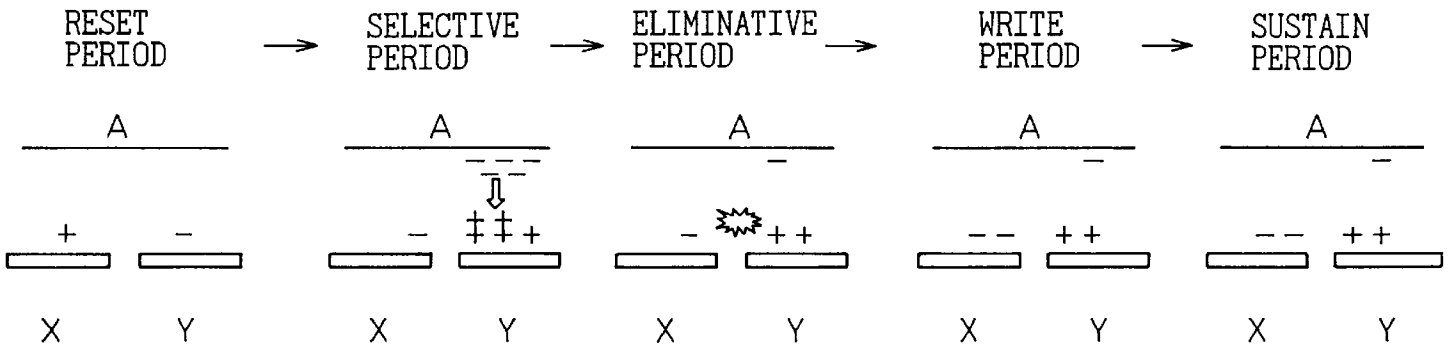

FIG. 4 is a diagram that shows the drive waveforms in the first embodiment, that is, the drive waveforms in a subfield. FIGS. 5A and 5B are diagrams that show the change of charges on each electrode in the first embodiment. With reference to FIGS. 5A and 5B, the action by the drive waveforms in FIG. 4 is described below.

As shown in FIG. 4, a reset pulse of a large voltage Vw is applied to the Y electrode in the reset period. At this time, a voltage of 0 V (ground level) is applied to the X electrode and the address electrode. By applying the reset pulse, discharge is carried out in all the cells and the wall charges are formed. Then a slope pulse is applied. The wall charges are not neutralized completely at this time and a certain amount of wall charge remains uniformly as shown in FIGS. 5A and 5B. Positive charges remain on the x electrode and negative charges remain on the Y electrode in this case.

The address period comprises the selective period, the eliminative period, and the write period.

In the selective period, the voltage Vs is applied to the X electrode and the Y electrode, and scan pulses are applied sequentially to the Y electrode so as to lower the voltage to 0 V, and in synchronization with this, an address signal of the voltage Va is applied to the address electrode of an OFF cell. In the OFF cell, the voltage of the wall charges is superposed on the voltage to be applied between the Y electrode and the address electrode, and the discharge is carried out, and positive charges accumulate on the Y electrode and negative charges accumulate on the address electrode. On the other hand, in the ON cell, discharge is not carried out because no voltage is applied, and the same wall charges, as those when the reset action is completed, remain. All the above-mentioned actions are carried out while applying scan pulses to all the Y electrodes sequentially, and in all the OFF cells on the entire surface, positive charges accumulate on the Y electrode, and negative charges, on the address electrode. In the selective period, because it is not necessary to form the wall charges by the surface discharge, the scan pulse and that of the address signal corresponding thereto can be short and the time required for the selective period can be considerably abbreviated compared to the case where the wall charges are formed by the surface discharge. Moreover, the amount of the wall charges remaining in the OFF cell after discharge does not need to be so precise because these charges are eliminated completely in the next eliminative discharge. In addition, because the voltage Vs is applied to the X electrode contiguous to the Y electrode of the OFF cell, the positive charges move to the Y electrode side during discharge and negative charges accumulate. The object, however, of the discharge in the selective period is to form the wall charges (positive charges, in this case) on the Y electrode by the discharge between the Y electrode and the address electrode, therefore, the charges on the X electrode do not bring about any problem.

In the eliminative period, while applying the voltage Vs to the Y electrode, a slope pulse whose voltage drops gradually from the voltage Vs is applied to the X electrode. In the OFF cell, the voltage of the wall charges accumulated on the X electrode and the Y electrodes is superposed on the slope pulse to result in discharge and the wall charges are eliminated. As disclosed in Japanese Unexamined Patent Publication (Kokai) No. 6-314078, it is possible to carry out discharge without fail by applying the slope pulse even if the amount of the wall charges accumulated on the X and Y electrodes varies, and the wall charges in the OFF cell are eliminated without fail. On the other hand, in the ON cell, because the voltage due to the wall charges has the opposite polarity, discharge is not carried out and the same amount of wall charges, as that at the completion of the reset action, remains. As described above, when the eliminative action is completed, the same amount of the wall charges as that at the completion of the reset action is reserved in the ON cell, and the wall charges are eliminated in the OFF cell. The obtuse waveform pulse is applied in the eliminative period, but this can take place to the entire surface simultaneously, therefore, the eliminative period is far shorter than the selective period.

In the write period, the voltage Vs is applied to the X electrode, the voltage 0 V to the Y electrode, and the voltage Va to the address electrode. By this, discharge is carried out in the ON cell because the voltage due to the wall charges of the same amount as that at the completion of the reset action is superposed, and the wall charges needed for the sustain action are formed. On the other hand, discharge is not carried out in the OFF cell because there is no wall charge. Because the application of pulses to each electrode in the write period is carried out to the entire surface simultaneously, the write period is far shorter than the selective period.

The address action is completed by the above-mentioned selective and write actions. As described above, because the eliminative and the write periods are shorter than the selective period, the time required for them can be ignored. Moreover, the scan pulse and the address signal to be applied in the eliminative period can be a pulse of a narrow width and it is possible to complete in a shorter time than when wall charges are formed by the surface discharge.

Furthermore, because the width of the scan pulse and the address signal to be applied in the eliminative period is narrow, the wall charges formed in the OFF cell vary in amount, but it is possible to carry out discharge without fail because the slope pulse is applied in the eliminative period, and the wall charges in the OFF cell are eliminated without fail. In addition, the wall charges needed for the sustain action are formed without fail in the write period, the stable action can be expected.

Figure 6:
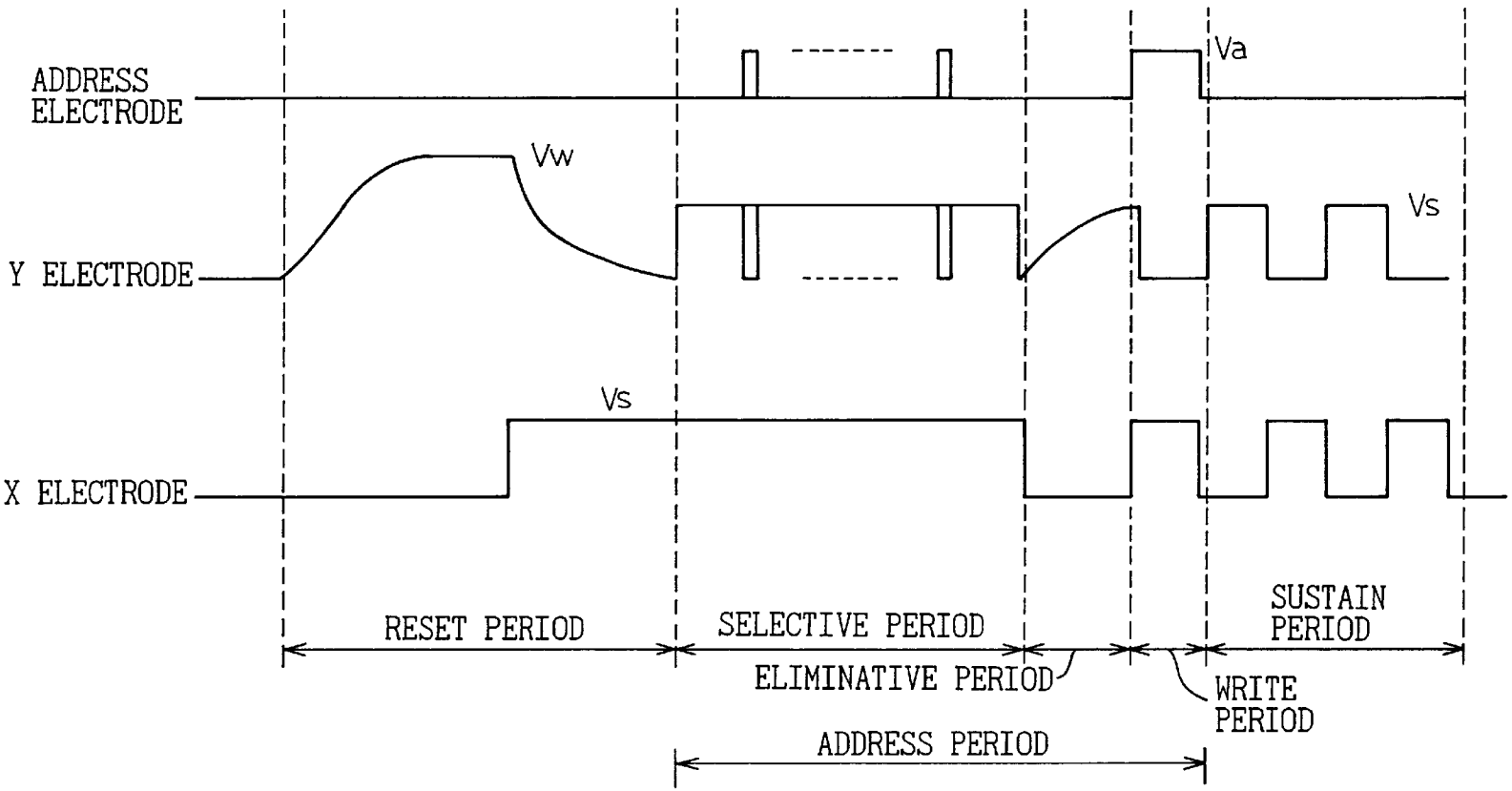
FIG. 6 is a diagram that shows the drive waveform in the second embodiment of the present invention.

FIG. 6 is a diagram that shows the drive waveform in the second embodiment of the present invention. The second embodiment is also an example case where the present invention is applied to the conventional plasma display apparatus, and differs from the first embodiment in that the slope pulse, which has been disclosed in Japanese Unexamined Patent Publication (Kokai) No.2000-75835, is applied in the reset period, and the slope pulse that increases gradually from the ground level to the voltage Vs is applied to the Y electrode, with the x electrode being set to the ground level in the eliminative period. By applying the slope pulse in the reset period, the amount of the wall charges after the reset period can be adjusted arbitrarily by the voltage between the X electrode and the Y electrode when the application of the slope pulse is completed.

In the eliminative period, although the slope pulse that increase gradually is applied to the Y electrode, opposite to that in the first embodiment, the attained effect it the same and it is possible to carry out discharge without fail even the wall charges accumulated on the X and Y electrodes in the OFF cell vary in amount, and the wall charges in the OFF cell are eliminated without fail.

Figure 7:
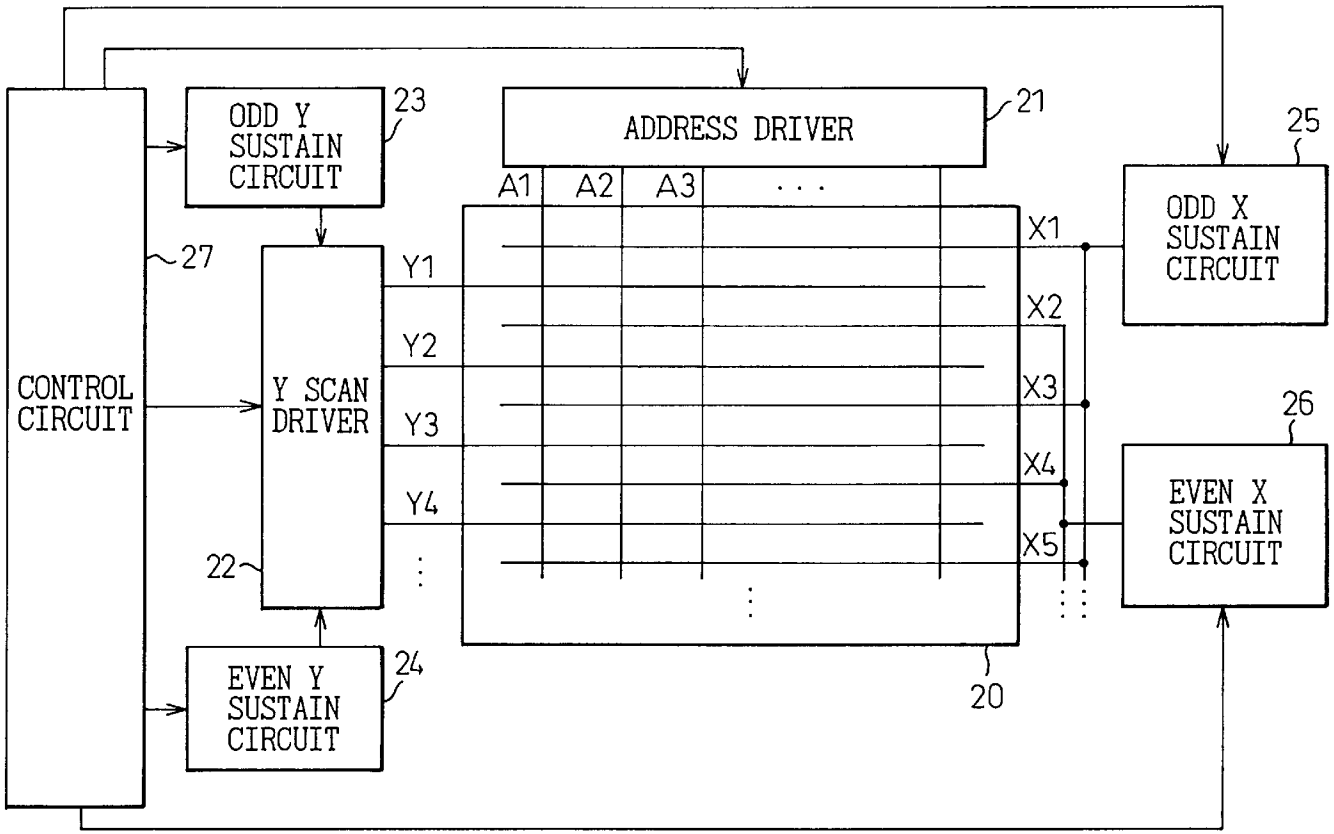
FIG. 7 is a block diagram that shows the structure of the plasma display apparatus used in the third embodiment of the present invention.

FIG. 7 is a diagram that shows the structure of the ALIS method plasma display apparatus used in the third embodiment of the present invention. Since the ALIS method plasma display apparatus has been disclosed in detail in EP 0 762 373 A2, a detailed description is not provided here, but only those parts relating to the characteristics of the present invention are described.

As shown in FIG. 7, in an ALIS method plasma display panel (PDP) 20, n Y electrodes (the second electrode) and (n+1) X electrodes (the first electrode) are arranged adjacently by turns, and light is emitted from every slit between display lines (Y electrode and X electrode). Therefore, 2n display lines are formed by (2n+1) display electrodes. In other words, in the ALIS method, the display definition can be doubled with the same number of the display electrodes of the conventional PD apparatus. Moreover, the discharge space can be used less wastefully, and a high opening ratio can be attained and a high brightness can be realized because the amount of light blocked by the electrodes is small.

An odd-numbered X electrode is driven by an odd X drive circuit 25, and an even-numbered x electrode is driven by an even X drive circuit 26. The Y electrode is driven by a Y scan driver 22. The Y scan driver 22 comprises a shift register and a drive circuit. The drive circuit applies the scan pulses generated by the shift register to the Y electrode sequentially in the address action, otherwise applies the signals generated by an odd Y sustain circuit 23 to the odd-numbered Y electrodes and those generated by an even Y sustain circuit 24 to the even-numbered Y electrodes. An address driver 21 applies data signals to the address electrode in synchronization with the scan pulse in the address action. A control circuit 27 generates the signals that control each circuit mentioned above. The above-mentioned structure is the same as that in the conventional ALIS method PD apparatus.

Figure 8:
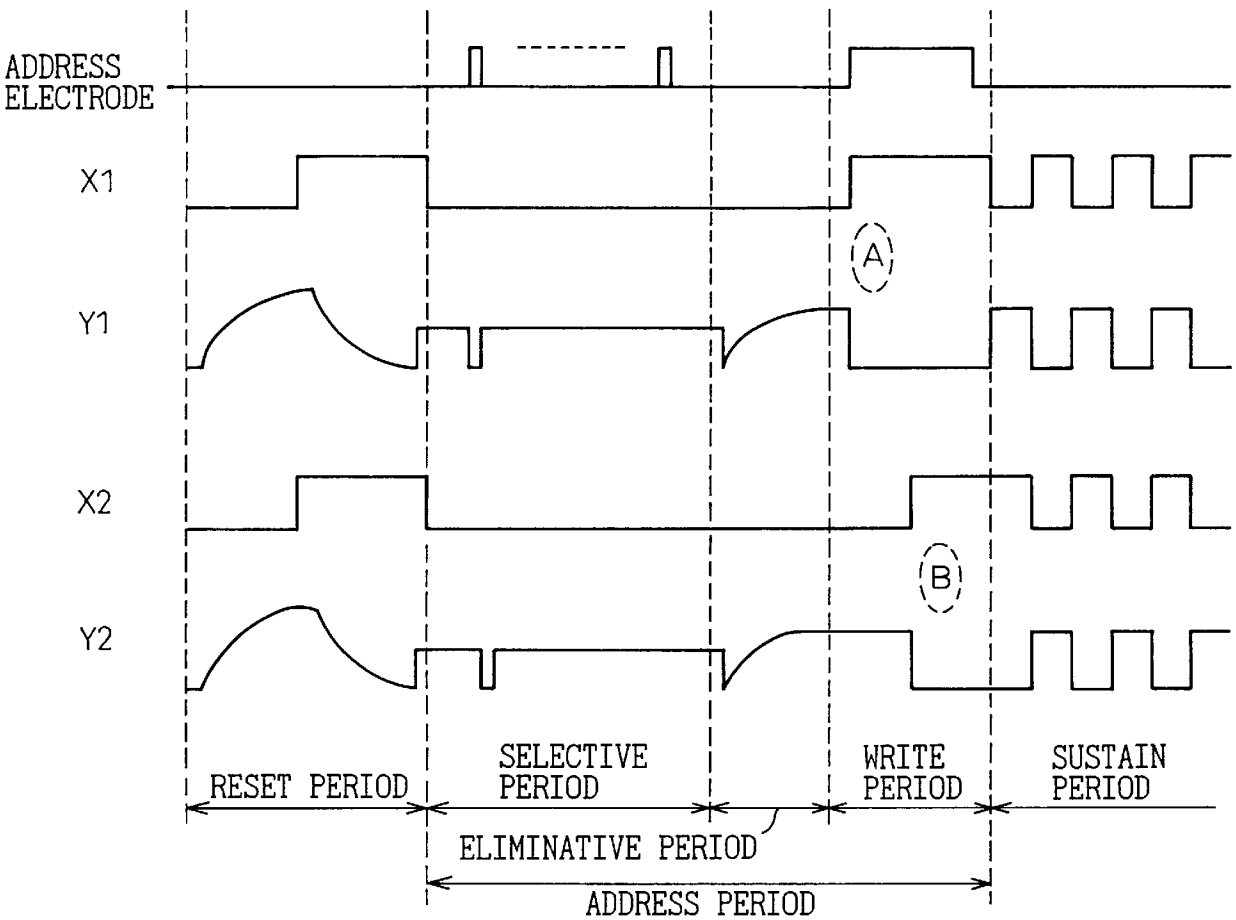
FIG. 8 is a diagram that shows the drive waveform in the odd field in the third embodiment of the present invention.
Figure 9:
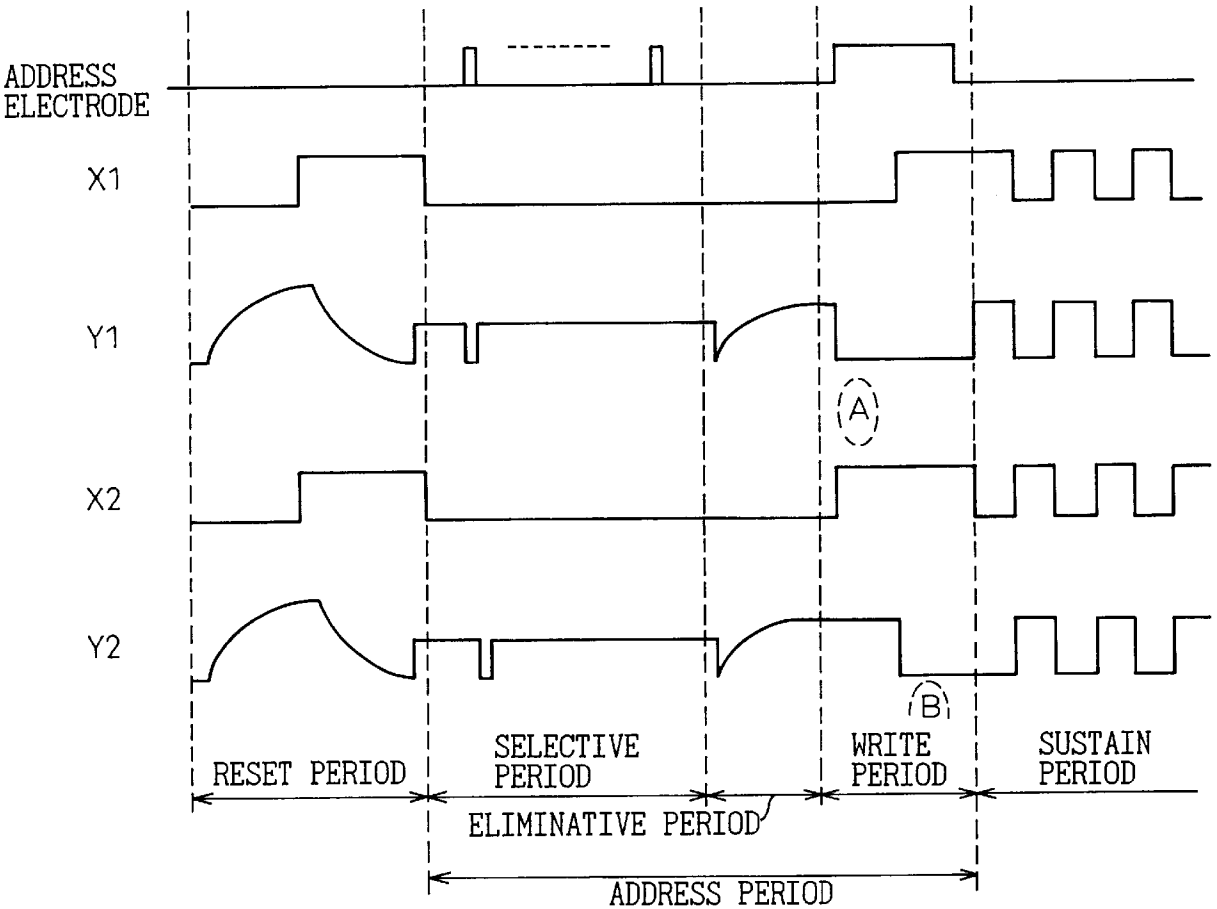
FIG. 9 is a diagram that shows the drive waveform in the even field in the third embodiment of the present invention.

FIGS. 8 and 9 are diagrams that show the drive waveforms of the plasma display apparatus in the third embodiment: FIG. 8 shows the drive waveforms in the odd field, and FIG. 9, those in the even field. In the ALIS method PD apparatus, every slit between electrodes is used for the discharge for display, but such discharge cannot be carried out simultaneously. Therefore, the so-called interlace scanning, in which display is formed by odd lines and even lines in a time-division manner, is carried out. In the ALIS method PD apparatus, the display line formed between the nth X electrode and the nth electrode, that is, the display line, as shown in FIG. 7, formed between the Y electrode and the upper X electrode is an odd-numbered display line, and that formed between the (n+1)th X electrode and the nth electrode, that is, the display line, as shown also in FIG. 7, formed between the Y electrode and the lower X electrode is an odd-numbered display line. In the odd field, display is established by the odd-numbered display lines and in the even field, established by even-numbered display lines, and the total display of those in the odd field and even filed is obtained.

As shown in FIGS. 8 and 9, in the reset period, the waveforms in the odd field and the even field are the same, and slope pulses are applied in the reset period similarly as in the second embodiment. Therefore, it is possible to adjust the amount of wall charges after the reset period arbitrarily by the voltage between the X electrode and the Y electrode when the application of the slope pulses is completed.

Moreover, the waveforms in the odd field and the even field are the same in the selective period and, with the voltage of the X electrode and the Y electrode being set to a fixed one, the negative-directed scan pulses are applied sequentially to make the potential of the Y electrode ground level and, in synchronization with this, address signals are applied to the address electrode. This address signal is a pulse that applies positive voltage to the cell without light emission, and no pulse is generated for the cell with light emission. This causes discharge between the Y electrode and the address electrode in the cell without light emission, and positive charges are accumulated on the Y electrode, as shown in FIG. 5(B). Also, in the selective period in the third embodiment, it is not necessary to form wall charges by surface discharge, therefore, the scan pulses and those corresponding thereto can be short and the time required for the selective period is short. Furthermore, the amount of wall charges remaining in the OFF cell does not need to be so precise, because these charges are eliminated completely by the next eliminative discharge. The address actions in the odd field and the even field are the same, the distributions of the wall charges on the Y electrode and on both the X electrodes contiguous thereto are the same, and there is no difference between the odd-numbered and the even-numbered display lines. Whether odd-numbered display lines or even-numbered display lines are selected is contingent on the selection in the later write period.

In the eliminative period, similarly as in the second embodiment, with the X electrode being set to the ground level, slope pulses, the voltage of which increases gradually from the ground level to the voltage Vs, are applied to the Y electrode. This enables the discharge to take place without fail even if the wall charges accumulated on the X and Y electrodes in the OFF cell vary in amount, and the wall charges in the OFF cell are eliminated without fail.

As shown in FIG. 8, in the write period in the odd field, the voltage Va is applied to the address electrode, and in the former half of the period, the voltage Vs is applied to the odd-numbered X electrode and the even-numbered Y electrode, and the voltage 0 V is applied to the even-numbered X electrode and the odd-numbered Y electrode to cause the write discharge A between the odd-numbered X electrode and the odd-numbered Y electrode. This causes discharge in the ON cell between the odd-numbered X electrode and the odd-numbered Y electrode because the voltage of the remaining wall charges in the cell, with the same amount as that when the reset action is completed, is superposed, and the wall charges needed for the sustain action are formed on the odd-numbered X electrode and the odd-numbered Y electrode. On the other hand, discharge does not take place in the OFF cell because there is no wall charge. At this time, discharge does not take place between the even-numbered X electrode and the even-numbered Y electrode because the voltage of the wall charges has the opposite polarity to the applied one. Because no voltage is applied between the even-numbered X electrode and the odd-numbered Y electrode, and between the odd-numbered X electrode and the even-numbered Y electrode, discharge does not take place. In other words, in the former half of the write period in the odd field, the wall charges needed for the next sustain discharge are formed in the odd-numbered display lines out of the odd display lines, and discharge does not take place in the even-numbered display lines out of the odd display lines and in the even display lines.

In the latter half of the write period in the odd field, the voltage Vs is applied to the even-numbered X electrode and the odd-numbered Y electrode, and the voltage 0 V is applied to the odd-numbered X electrode and the even-numbered Y electrode to cause the write discharge B between the even-numbered X electrode and the odd-numbered Y electrode. This causes discharge in the ON cell between the even-numbered x electrode and the odd-numbered Y electrode because the voltage of the remaining wall charges in the cell, with the same amount as that when the reset action is completed, is superposed, and the wall charges needed for the next sustain action are formed, but discharge does not take place in the OFF cell because there is no wall charge. Similarly, discharge does not take place in the even display lines.

When the above-mentioned write period is completed, the wall charges needed for the next sustain discharge are formed on the odd-numbered X electrode and the odd-numbered Y electrode that constitute the odd display line, and on the even-numbered X electrode and the even-numbered Y electrode. Because the application of pulses to each electrode in the write period takes place on the entire surface simultaneously, the write period is by far shorter than the selective period. As described above, whether odd display lines or the even display lines are selected is contingent on the selection in the write period.

Next, when sustain pulses of opposite polarity to each other are applied to a pair of the odd-numbered X electrode and the even-numbered Y electrode, and to a pair of the even-numbered X electrode and the odd-numbered Y electrode, respectively, in the sustain period, the sustain discharge takes place in the odd display line.

As shown in FIG. 9, the waveforms in the reset period, the selective period, and the eliminative period in the even field are the same as those in the odd field. In the write period in the even field, the voltage Vs is applied to the even-numbered Y electrode and the even-numbered Y electrode in the former half of the period, and the voltage 0 V is applied to the odd-numbered X electrode and the odd-numbered Y electrode to cause the write discharge A between the even-numbered X electrode and the odd-numbered Y electrode. This causes the wall charges needed for the next sustain discharge to form on the odd-numbered display lines out of the odd display lines and discharge does not take place in the even-numbered display lines out of the even display lines and in the odd display lines. In the latter half of the write period in the even field, the voltage Vs is applied to the odd-numbered X electrode and the odd-numbered Y electrode, and the voltage 0 V is applied to the even-numbered X electrode and the even-numbered X electrode to cause the write discharge B between the odd-numbered X electrode and the even-numbered Y electrode. This causes the wall charges needed for the next sustain discharge to form in the even-numbered display lines out of the even display lines, and discharge does not take place in the odd display lines.

When the above-mentioned write period is completed, the wall charges needed for the next sustain discharge are formed in the even-numbered X electrode and the odd-numbered Y electrode that constitute the even display lines and on the even-numbered X electrode and the odd-numbered Y electrode. Similarly, because the application of pulses to each electrode in the write period takes place on the entire surface simultaneously, the write period is by far shorter than the selective period. In the following, the same action takes place as that in the odd field in the sustain period.

In the third embodiment, despite using the ALIS method, the actions in the reset period, the selective period, and the eliminative period are same in both the odd field and the even field, and the selection between the odd display lines and the even display lines is made in the write period, but the selection between the odd display lines and the even display lines can be made in the selective period. The fourth embodiment of the present invention is the case where the selection between the odd display lines and the even display lines is made in the ALIS method plasma display apparatus.

Figure 10:
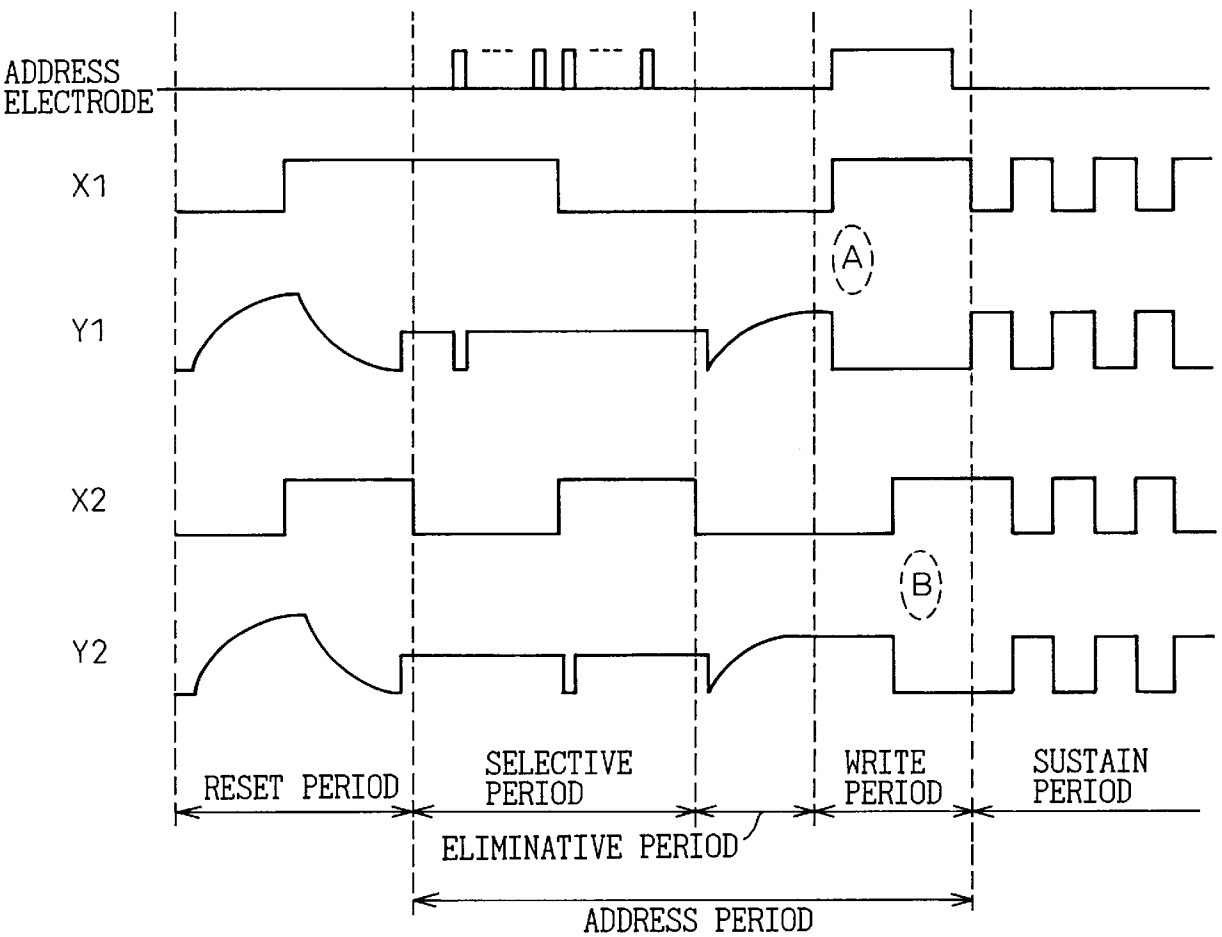
FIG. 10 is a diagram that shows the drive waveform in the odd field in the fourth embodiment of the present invention.
Figure 11:
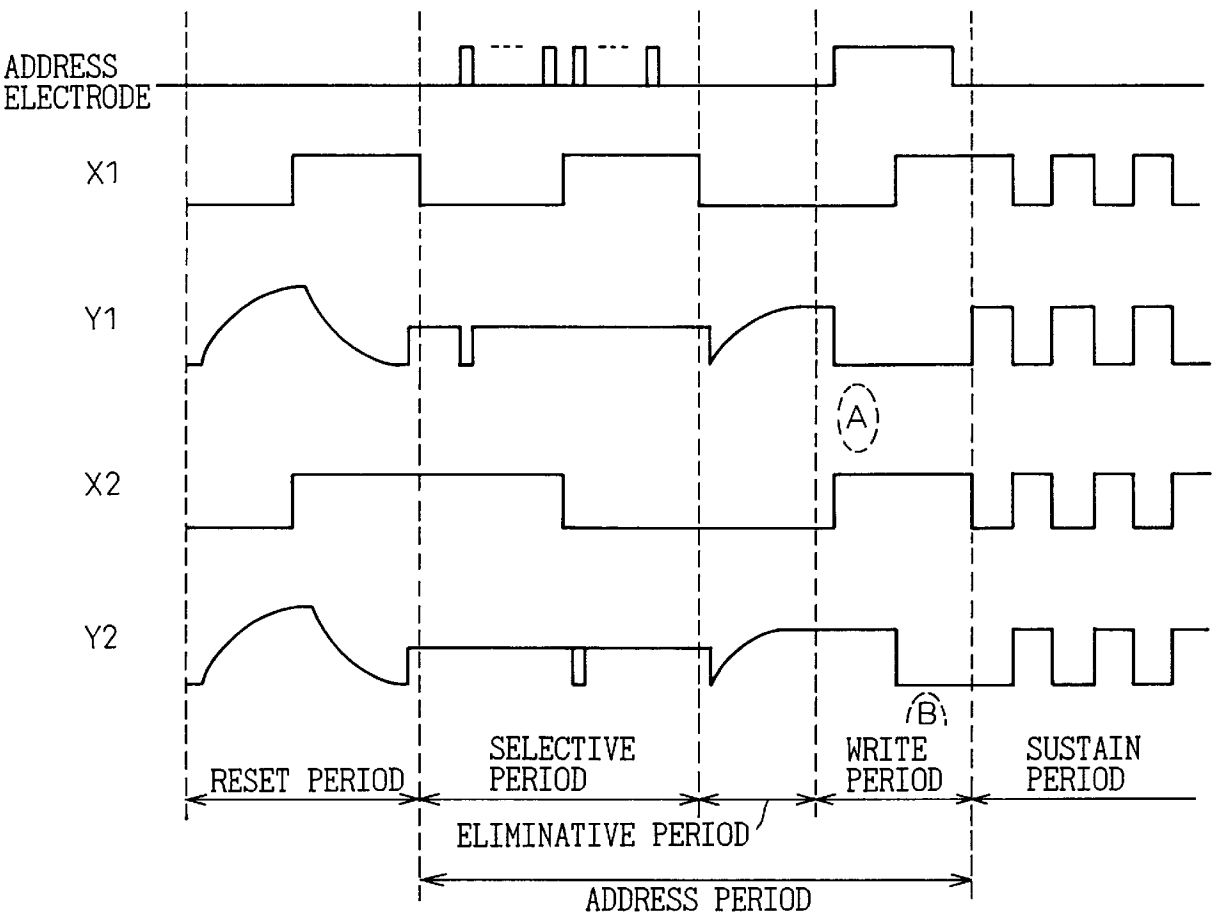
FIG. 11 is a diagram that shows the drive waveform in the even field in the fourth embodiment of the present invention.

The plasma display apparatus in the fourth embodiment of the present invention has a structure similar to that in FIG. 7, and driven by the drive waveforms shown in FIGS. 10 and 11. FIG. 10 shows the drive waveforms in the odd field, and FIG. 11, those in the even field.

In the plasma display apparatus in the fourth embodiment, the selective period is divided into the former half and the latter half and selection is made. As shown in FIG. 10, in the selective period in the odd field, positive voltage is applied to the X electrode, the voltage V0 is applied to the even-numbered X electrode, scan pulses are applied sequentially to the odd-numbered Y electrode and, in synchronization with this, address signals are applied to the address electrode in the former half of the period. During this time, positive voltage is applied to the even-numbered Y electrode. Then the voltage 0V is applied to the odd-numbered X electrode, positive voltage is applied to the even-numbered x electrode, scan pulses are applied to the even-numbered Y electrode sequentially, and in synchronization with this, address signals are applied to the address electrode in the latter half of the period. During this time, positive voltage is applied to the odd-numbered Y electrode. This causes discharge on the Y electrode in the OFF cell and positive charges accumulate, but the accumulation of negative charges by the discharge on the X electrode side makes it more likely that charges accumulate on the X electrode side that forms the odd display line, and more unlikely on the X electrode side that forms the even display line. Therefore, the discharge in the case where charges in the OFF cell are eliminated in the eliminative period becomes more likely to take place toward the X electrode side that forms the odd display line and the influence of the wall charges on the x electrode side that forms the even display line is reduced compared to the case in the third embodiment. These X electrodes that form the even display lines are those that form the next odd display lines, and because the influence of the selective action of the contiguous display line in the selective period is reduced, the action in the write period is made to take place more surely.

As shown in FIG. 11, in the selective period in the even field in the fourth embodiment, a positive voltage is applied to the even-numbered X electrode, the voltage 0V is applied to the odd-numbered x electrode, scan pulses are applied to the odd-numbered Y electrode sequentially, and in synchronization with this, address signals are applied to the address electrode in the former half of the period. In the latter half of the period, the voltage 0 V is applied to the even-numbered X electrode, positive voltage is applied to the odd-numbered X electrode, scan pulses are applied to the even-numbered Y electrode sequentially and, in synchronization with this, address signals are applied to the address electrode.

Figure 2:
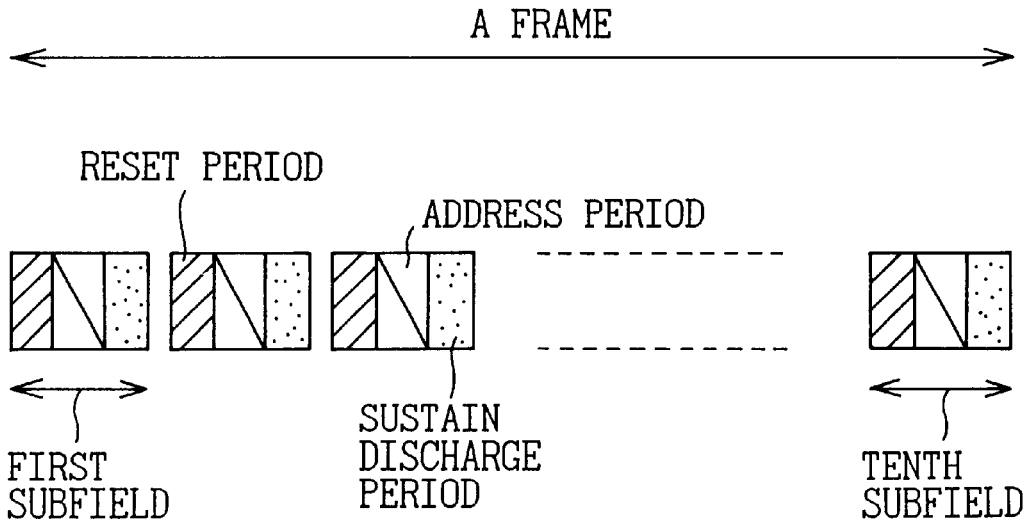
FIG. 2 is a diagram that shows the frame structure to carry out the gradation display in the plasma display apparatus.
Figure 3:
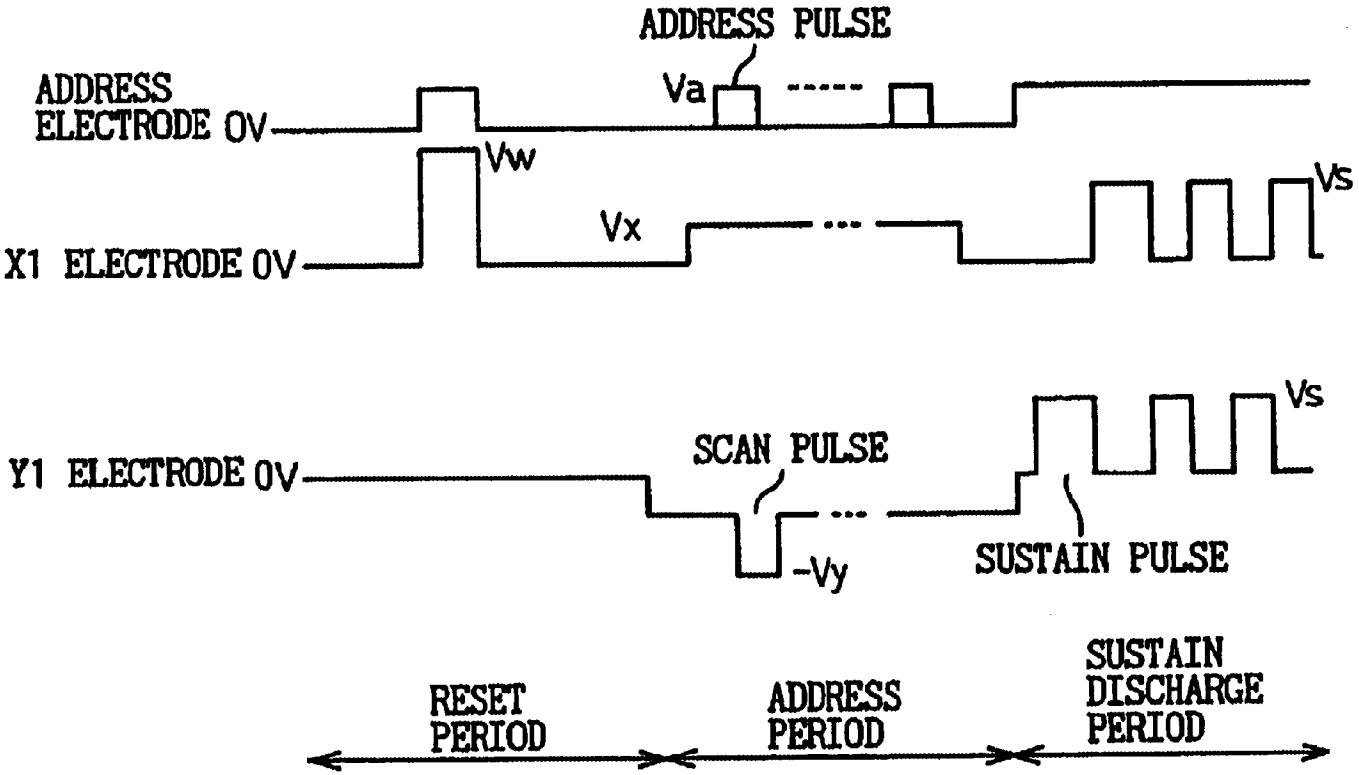
Fig.3 PRIOR ART
FIG. 3 is a waveform chart that shows the conventional drive method of the plasma display apparatus.
Figure 12:
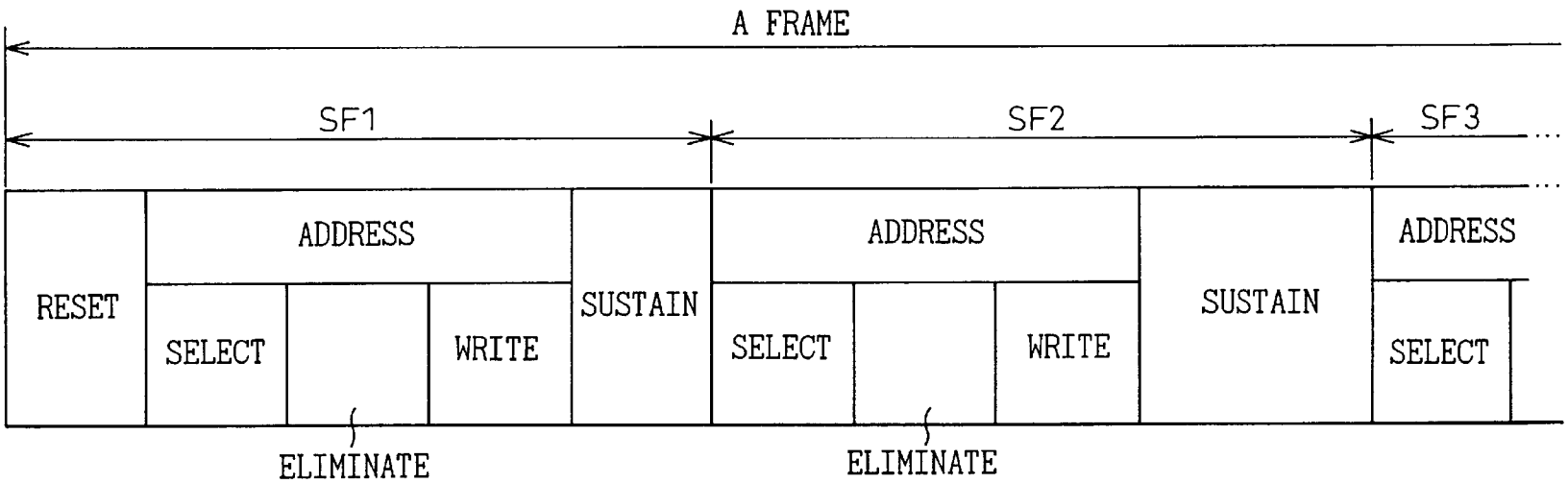
FIG. 12 is a diagram that shows the frame structure of the drive sequence in the fifth embodiment of the present invention.

FIG. 12 is a diagram that shows the frame structure in the drive sequence of the plasma display apparatus in the fifth embodiment of the present invention. In the first through the fourth embodiments, the subfield that constitutes a frame has the reset period, the address period, and the sustain period, respectively, as shown in FIG. 2. It is possible to provide the reset period only to the first subfield of each frame, and the reset periods in other subfields can be removed. In the plasma display apparatus of the present invention, the address period comprises the selective period, the eliminative period, and the write period, therefore, the frame has a structure as shown in FIG. 12. In the case of the drive sequence in the fifth embodiment, because the number of the reset periods accompanied by the light emission, which is not related to display, is reduced, the display contrast is improved.

As described above, according to the present invention, the address action can be made to take place in a short time without fail, therefore, it becomes possible to improve the display brightness by lengthening the time of the sustain period, or attain a high-level-gradation display by increasing the number of subfields that constitute a frame.

We claim:

1. A plasma display drive method, comprising:

a reset action to initialize a display cell, an address action to set the display cell to a state according to the display data after the reset action, and a sustain action to cause light emission in an ON cell selectively according to the state of the display cell set in the address action, wherein the address action has:

a selective action to select an OFF cell, an eliminative action to eliminate wall charges in the OFF cell selected in the selective action, and a write action to form the wall charges needed for the sustain action in the ON cell.

2. A plasma display drive method as set forth in claim 1, wherein the plasma display comprises first electrodes and second electrodes that are arranged adjacently by turns and extend in a first direction, and third electrodes that extend in the second direction perpendicular to the first direction, further comprising:

the selective action is carried out by the application of address signals, which select the OFF cell, to the third electrode, in synchronization with the application of scan pulses to the second electrode, resulting in discharge between the second electrode and the third electrode; and the selective action is completed before a substantial transition to a discharge between the first electrode and the second electrode.

3. A plasma display drive method as set forth in claim 2, wherein the voltage applied to the first electrode and the second electrode changes gradually in the eliminative action.

4. A plasma display drive method as set forth in claim 1, wherein the plasma display comprises the first electrodes and the second electrodes that are arranged adjacently by turns and extend in the first direction and the third electrodes that extend in the second direction perpendicular to the first direction, and, wherein:

in the write action, the voltage, which at least causes a selective discharge by the remaining wall charges in the reset action, is applied between the first electrode and the second electrode so that a discharge takes place and the wall charges needed for the sustain action are formed.

5. A plasma display drive method as set forth in claim 1, wherein the plasma display comprises first electrodes and second electrodes that are arranged adjacently by turns and extend in a first direction and third electrodes that extend in a second direction perpendicular to the first direction; a first display line is formed between one side of the second electrode and the first electrode contiguous thereto, and a second display line is formed between the other side of the second electrode and the first electrode contiguous thereto; a display of a frame is comprised of: an odd field, in which display is established by the first display lines, and an even field, in which display is established by the second display lines; and wherein:

in write action in the odd field, a voltage, which has a polarity to cause a write discharge, is applied between the first electrode and the second electrode that constitute the first display line, but a voltage, which has a polarity to cause a write discharge, is not applied between the first electrode and the second electrode that constitute the second display line; and in a write action in the even field, a voltage, which has a polarity to cause a write discharge, is applied between the first electrode and the second electrode that constitute the second display line, but a voltage, which has a polarity to cause a write discharge, is not applied between the first electrode and the second electrode that constitute the first display line.

6. A plasma display drive method as set forth in claim 5, wherein:

the write action has a period during which a voltage is applied between the first electrode and the second electrode that constitute an odd-numbered first or second display line, and a period during which a voltage is applied between the first electrode and the second electrode that constitute an even-numbered first or second display line.

7. A plasma display drive method, comprising:

an address action to set an initialized display cell to a state according to display data; and a sustain action to cause light emission in an ON cell, selectively, according to the state of the display cell set in the address action, wherein the address action has:

a selective action to select an OFF cell, an eliminative action to eliminate wall charges in the OFF cell, selected in the selective action, and a write action to form the wall charges needed for the sustain action in the ON cell.

8. A plasma display drive method as set forth in claim 7, wherein the plasma display comprises first electrodes and second electrodes that are arranged adjacently by turns and extend in a first direction and third electrodes that extend in a second direction perpendicular to the first direction further comprising:

in the write action, a voltage, which at least causes selective discharge by remaining wall charges in the initialized display cell, is applied between the first electrode and the second electrode so that discharge takes place and the wall charges needed for the system action are formed.

9. A plasma display drive method as set forth in claim 8, wherein the plasma display comprises first electrodes and second electrodes that are arranged adjacently by turns and extend in a first direction, and third electrodes that extend in the second direction perpendicular to the first direction, further comprising:

the selective action is carried out by the application of address signals, which select the OFF cell, to the third electrode, in synchronization with the application of scan pulses to the second electrode, resulting in discharge between the second electrode and the third electrode; and the selective action is completed before a substantial transition to a discharge between the first electrode and the second electrode.

10. A plasma display drive method as set forth in claim 9, wherein the voltage applied to the first electrode and the second electrode changes gradually in the eliminative action.

11. A plasma display drive method as set forth in claim 9, wherein the plasma display comprises first electrodes and second electrodes that are arranged adjacently by turns and extend in a first direction and third electrodes that extend in a second direction perpendicular to the first direction; a first display line is formed between one side of the second electrode and the first electrode contiguous thereto, and a second display line is formed between the other side of the second electrode and the first electrode contiguous thereto; a display of a frame is comprised of an odd field, in which display is established by the first display lines, and an even field, in which display is established by the second display lines; and wherein:

in write action in the odd field, a voltage, which has a polarity to cause a write discharge, is applied between the first electrode and the second electrode that constitute the first display line, but a voltage, which has a polarity to cause a write discharge, is not applied between the first electrode and the second electrode that constitute the second display line; and in a write action in the even field, a voltage, which has a polarity to cause a write discharge, is applied between the first electrode and the second electrode that constitute the second display line, but a voltage, which has a polarity to cause a write discharge, is not applied between the first electrode and the second electrode that constitute the first display line.

12. A plasma display drive method as set forth in claim 11, wherein:

the write action has a period during which a voltage is applied between the first electrode and the second electrode that constitute an odd-numbered first or second display line, and a period during which a voltage is applied between the first electrode and the second electrode that constitute an even-numbered first or second display line.

* * * * *